US006049285A

United States Patent [19]

Mangal et al.

[11] Patent Number: 6,049,285

[45] Date of Patent: Apr. 11, 2000

[54] GARAGE DOOR STATUS INDICATOR

[76] Inventors: Seegobind Mangal; Kyosei Yano, both of 2 Richmond Park Boulevard, Scarborough, Ontario, Canada, M1V 3C7

[21] Appl. No.: 09/220,939

[22] Filed: Dec. 24, 1998

[51] Int. Cl.[7] ..... G08B 21/00

[52] U.S. Cl. ..... 340/686.1; 340/480; 340/445; 340/466; 340/545.1; 340/691; 340/521; 340/569; 340/545.9; 318/468; 49/25; 70/134

[58] Field of Search ..... 340/686.1, 545.1, 340/691.4, 521, 569, 545.9; 318/480, 445, 466, 468; 49/25; 70/134

[56] References Cited

U.S. PATENT DOCUMENTS

| | | | |
|---|---|---|---|
| 4,593,543 | 6/1986 | Stafanek | 70/134 |
| 4,763,937 | 8/1988 | Sittnick, Jr. et al. | 292/251.5 |
| 4,847,542 | 7/1989 | Clark et al. | 318/560 |
| 4,954,810 | 9/1990 | Llewellyn | 340/545 |
| 5,465,033 | 11/1995 | Fassih-Nia | 318/480 |
| 5,518,028 | 5/1996 | Walker | 137/554 |
| 5,589,747 | 12/1996 | Utke | 318/468 |
| 5,689,236 | 11/1997 | Kister | 340/545 |

*Primary Examiner*—Jeffery A. Hofsass
*Assistant Examiner*—Tai T. Nguyen

[57] ABSTRACT

A garage door status indicating system is provided including a power source. Also included is a switch having a first orientation when the garage door is open and a second orientation when the garage door is closed. A first indication circuit includes a red diode adapted to illuminate intermittently upon the switch being in the first orientation thereof, thereby indicating that the garage door is open. Associated therewith is a second indication circuit including a green diode adapted to illuminate continuously upon the switch being in the second orientation thereof, thereby indicating that the garage door is closed.

7 Claims, 1 Drawing Sheet

GARAGE DOOR STATUS INDICATOR

BACKGROUND OF THE INVENTION

1. Field of the Invention

The present invention relates to garage door control systems and more particularly pertains to a new garage door status indicator for indicating a current status of a garage door.

2. Description of the Prior Art

The use of garage door control systems is known in the prior art. More specifically, garage door control systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art garage door control systems include U.S. Pat. Nos. 5,402,105; 5,455,733; 4,777,479; 4,583,081; U.S. Pat. No. Des. 312,979; and U.S. Pat. No. 3,233,054.

In these respects, the garage door status indicator according to the present invention substantially departs from the conventional concepts and designs of the prior art, and in so doing provides an apparatus primarily developed for the purpose of indicating a current status of a garage door.

SUMMARY OF THE INVENTION

In view of the foregoing disadvantages inherent in the known types of garage door control systems now present in the prior art, the present invention provides a new garage door status indicator construction wherein the same can be utilized for indicating a current status of a garage door.

The general purpose of the present invention, which will be described subsequently in greater detail, is to provide a new garage door status indicator apparatus and method which has many of the advantages of the garage door control systems mentioned heretofore and many novel features that result in a new garage door status indicator which is not anticipated, rendered obvious, suggested, or even implied by any of the prior art garage door control systems, either alone or in any combination thereof.

To attain this, the present invention generally comprises an alternating current source. As shown in FIG. 1, a step down transformer has an input connected to the alternating current source for affording a voltage at an output thereof. It should be noted that such voltage is less than that received at the input of the transformer. Also included is a rectifier having an input connected to the output of the transformer. In use, the rectifier functions for rectifying current receiving from the transformer. Connected between the transformer and the rectifier is a fuse for precluding the flow of current to the rectifier upon the same surpassing a predetermined amount. For converting current from the rectifier to a direct current, a capacitor is connected to an output of the rectifier in parallel therewith. Also included is a double pole double throw switch connected to the capacitor and further situated on a garage door of a garage. A shown in FIG. 1, the switch includes a first pair of output terminals and a second pair of output terminals. In operation, the switch has an unbiased orientation for connecting the capacitor to the first pair of output terminals. As such, direct current is supplied to the first pair of output terminals when the garage door is open. The switch further has a biased orientation for connecting the capacitor to the second pair of output terminals for supplying direct current thereto when the garage door is closed. A first indication circuit includes an integrated circuit having four NOR gates of which two are utilized. A first NOR gate has a first input connected to a first one of the first pair of output terminals of the switch. A second input of the first NOR gate is connected to a second one of the first pair of output terminals of the switch. Associated therewith is a second NOR gate having a first input connected to an output of the first NOR gate. The second NOR gate further has a second input connected to the second one of the first pair of output terminals of the switch. Connected between an output of the second NOR gate and the second one of the first pair of output terminals of the switch is a first red diode. By the foregoing components, the red diode is adapted to illuminate intermittently upon the receipt of direct current by the first circuit. This indicates that the garage door is open. Finally, a second indication circuit is provided including a resistor and a green diode connected in series. Such series combination is in turn connected between the second pair of output terminals of the switch. As such, the green diode is adapted for illuminating continuously upon the receipt of direct current by the second circuit, thereby indicating that the garage door is closed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garage door status indicator apparatus and method which has many of the advantages of the garage door control systems mentioned heretofore and many novel features that result in a new garage door status indicator which is not anticipated, rendered obvious, suggested, or even implied by any of the prior art garage door control systems, either alone or in any combination thereof.

It is another object of the present invention to provide a new garage door status indicator which may be easily and efficiently manufactured and marketed.

It is a further object of the present invention to provide a new garage door status indicator which is of a durable and reliable construction.

An even further object of the present invention is to provide a new garage door status indicator which is susceptible of a low cost of manufacture with regard to both materials and labor, and which accordingly is then susceptible of low prices of sale to the consuming public, thereby making such garage door status indicator economically available to the buying public.

Still yet another object of the present invention is to provide a new garage door status indicator which provides in the apparatuses and methods of the prior art some of the advantages thereof, while simultaneously overcoming some of the disadvantages normally associated therewith.

Still another object of the present invention is to provide a new garage door status indicator for indicating a current status of a garage door.

Even still another object of the present invention is to provide a new garage door status indicator that includes a power source. Also included is a switch having a first orientation when the garage door is open and a second orientation when the garage door is closed. A first indication circuit includes a red diode adapted to illuminate intermittently upon the switch being in the first orientation thereof, thereby indicating that the garage door is open. Associated therewith is a second indication circuit including a green diode adapted to illuminate continuously upon the switch being in the second orientation thereof, thereby indicating that the garage door is closed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
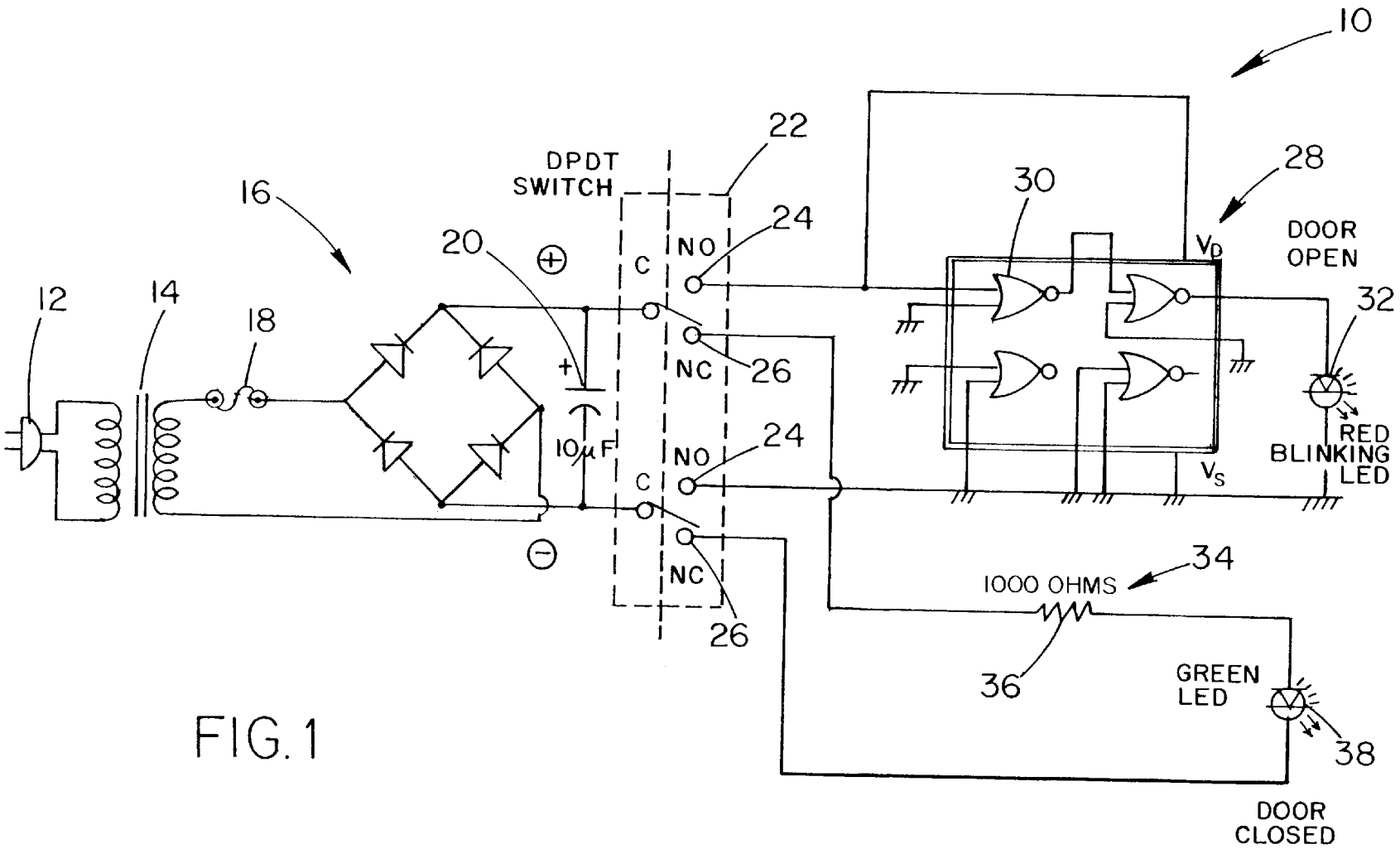
FIG. 1 is a schematic diagram of a new garage door status indicator according to the present invention.

With reference now to the drawings, and in particular to FIG. 1 thereof, a new garage door status indicator embodying the principles and concepts of the present invention and generally designated by the reference numeral 10 will be described.

The present invention, designated as numeral 10, includes an alternating current source which is connected to the remaining components of the present invention via a plug 12. As shown in FIG. 1, a step down transformer 14 has an input connected to the alternating current source for affording a voltage at an output thereof. It should be noted that such voltage is less than that received at the input of the transformer.

Also included is a rectifier 16 having an input connected to the output of the transformer. In use, the rectifier functions for rectifying current receiving from the transformer. To accomplish this, the rectifier preferably comprises four interconnected diodes. Note FIG. 1. Connected between the transformer and the rectifier is a fuse 18 for precluding the flow of current to the rectifier upon the same surpassing a predetermined amount. For converting current received from the rectifier to a direct current, a 10 uF capacitor 20 is connected to an output of the rectifier in parallel therewith.

Also included is a double pole double throw (DPDT) switch 22 connected to the capacitor and further situated on a garage door of a garage. A shown in FIG. 1, the switch includes a first pair of output terminals 24 and a second pair of output terminals 26. In operation, the switch has an unbiased orientation for connecting the capacitor to the first pair of output terminals. As such, direct current is supplied to the first pair of output terminals when the garage door is open. The switch further has a biased orientation for connecting the capacitor to the second pair of output terminals for supplying direct current thereto when the garage door is closed. The closing of the switch may be effected by an abutment with a ground surface below the garage door.

A first indication circuit 28 includes an integrated circuit having four NOR gates 30 of which two are utilized. A first NOR gate has a first input connected to a first one of the first pair of output terminals of the switch. A second input of the first NOR gate is connected to a second one of the first pair of output terminals of the switch. Associated therewith is a second NOR gate having a first input connected to an output of the first NOR gate. The second NOR gate further has a second input connected to the second one of the first pair of output terminals of the switch.

Connected between an output of the second NOR gate and the second one of the first pair of output terminals of the switch is a first red diode 32. By the foregoing components, the red diode is adapted to illuminate intermittently upon the receipt of direct current by the first circuit. This indicates that the garage door is open. It should be noted that the intermittent fashion in which the red diode illuminates is critical in attracting particular attention to the scenario that it represents.

Finally, a second indication circuit 34 is provided including a 1000 OHM resistor 36 and a green diode 38 connected in series. Such series combination is in turn connected between the second pair of output terminals of the switch. As such, the green diode is adapted for illuminating continuously upon the receipt of direct current by the second circuit, thereby indicating that the garage door is closed.

It should be noted that the power source components and first and second indication circuits are situated on a panel. The panel is then connected to the switch by way of an elongated wire. As such, the panel may be mounted within a home associated with the garage where it can be monitored.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A garage door status indicating system comprising, in combination:

an alternating current source;

a step down transformer having an input connected to the alternating current source for affording a voltage at an output thereof which is less than that received at the input thereof;

a rectifier having an input connected to the output of the transformer for rectifying current receiving from the transformer;

a fuse connected between the transformer and the rectifier for precluding the flow of current to the rectifier upon the same surpassing a predetermined amount;

a capacitor connected to an output of the rectifier in parallel therewith for converting current from the rectifier to a direct current;

a double pole double throw switch connected to the capacitor and further situated on a garage door of a garage, the switch including a first pair of output terminals and a second pair of output terminals, wherein the switch has an unbiased orientation for connecting the capacitor to the first pair of output terminals for supplying direct current thereto when the garage door is open and a biased orientation for connecting the capacitor to the second pair of output terminals for supplying direct current thereto when the garage door is closed;

a first indication circuit including an integrated circuit having a first NOR gate with a first input connected to a first one of the first pair of output terminals of the switch and a second input connected to a second one of the first pair of output terminals of the switch, a second NOR gate having a first input connected to an output of the first NOR gate and a second input connected to the second one of the first pair of output terminals of the switch, a first red diode connected between an output of the second NOR gate and the second one of the first pair of output terminals of the switch, wherein the red diode is adapted to illuminate intermittently upon the receipt of direct current by the first circuit thereby indicating that the garage door is open; and a second indication circuit including a resistor and a green diode connected in series between the second pair of output terminals of the switch for illuminating continuously upon the receipt of direct current by the second circuit thereby indicating that the garage door is closed;

wherein the first and second indication circuits are situated on a panel which is mounted within a home associated with the garage.

2. A garage door status indicating system comprising:

a power source;

a switch having a first orientation when the garage door is open and a second orientation when the garage door is closed;

a first indication circuit including a first NOR gate with a first input connected to a first one of a pair of output terminals of the switch and a second input connected to a second one of the pair of output terminals of the switch, a second NOR gate having a first input connected to an output of the first NOR gate and a second input connected to the second one of the pair of output terminals of the switch, a red diode connected between an output of the second NOR gate and the second one of the pair of output terminals of the switch wherein the red diode is adapted to illuminate intermittently upon the receipt of direct current by the first circuit thereby indicating that the garage door is open; and a second indication circuit including a green diode adapted to illuminate continuously upon the switch being in the second orientation thereof, thereby indicating that the garage door is closed;

wherein the first and second indication circuits are situated within a home associated with the garage.

3. The garage door status indicating system as set forth in claim 2 wherein the power source comprises:

an alternating current source;

a step down transformer having an input connected to the alternating current source for affording a voltage at an output thereof which is less than that received at the input thereof;

a rectifier having an input connected to the output of the transformer for rectifying current receiving from the transformer;

a fuse connected between the transformer and the rectifier for precluding the flow of current to the rectifier upon the same surpassing a predetermined amount; and a capacitor connected to an output of the rectifier in parallel therewith for converting current from the rectifier to a direct current.

4. The garage door status indicating system as set forth in claim 2 wherein the switch is a double pole double throw switch.

5. The garage door status indication system as set forth in claim 2 wherein the second indication circuit includes a resistor and the green diode being connected in series between a second pair of output terminals of the switch for illuminating continuously upon the receipt of direct current by the second circuit thereby indicating that the garage door is closed.

6. The garage door status indicating system as set forth in claim 5 wherein the power source comprises:

an alternating current source;

a step down transformer having an input connected to the alternating current source for affording a voltage at an output thereof which is less than that received at the input thereof;

a rectifier having an input connected to the output of the transformer for rectifying current receiving from the transformer;

a fuse connected between the transformer and the rectifier for precluding the flow of current to the rectifier upon the same surpassing a predetermined amount; and a capacitor connected to an output of the rectifier in parallel therewith for converting current from the rectifier to a direct current.

7. The garage door status indicating system as set forth in claim 5 wherein the switch is a double pole double throw switch.

* * * * *